United States Patent [19]

Burns

[11] Patent Number: 4,686,716

[45] Date of Patent: Aug. 18, 1987

[54] NECKTIE HOLDER

[76] Inventor: David R. Burns, 9000 Zuni SE., Albuquerque, N. Mex. 87123

[21] Appl. No.: 810,496

[22] Filed: Dec. 19, 1985

[51] Int. Cl.[4] ..... A41D 25/08

[52] U.S. Cl. ..... 2/152 R; 2/323; 2/325; 24/49 R; 24/49 CF; 24/56; 24/3 B; 24/115 H; 24/298

[58] Field of Search ..... 24/49 R, 49 CF, 49 S, 24/54, 56–59, 49 CC, 49 P, 50, 300–302, 298, 3 L, 3 M, 3 A, 3 B, 115 H, 49 C, 52, 58, 65, 89, 299, 345, 346; 2/145, 335, 323, 325

[56] References Cited

U.S. PATENT DOCUMENTS

| | | | |
|---|---|---|---|
| 496,696 | 5/1893 | Nash | 24/115 H |
| 1,491,578 | 4/1924 | Ballou et al. | 24/299 X |
| 1,586,251 | 5/1926 | Lang | 24/115 H |
| 1,704,659 | 3/1929 | Dowd | 24/56 |
| 2,059,301 | 11/1936 | Albright | 24/49 CF |
| 2,195,594 | 4/1940 | Kreisler | 24/49 CF X |
| 2,297,661 | 9/1942 | Okun | 24/3 M |
| 2,572,889 | 10/1951 | Strykower | 24/3 B X |
| 2,713,706 | 7/1955 | Biagi | 24/115 R X |
| 3,173,181 | 3/1965 | Marien | 24/49 CF |
| 3,529,327 | 9/1970 | Missakian | 28/56 |
| 3,979,795 | 9/1976 | Seron | 24/299 X |
| 4,109,905 | 8/1978 | Meier | 24/115 H X |
| 4,173,793 | 11/1977 | Yasui | 24/49 CF |
| 4,319,428 | 3/1982 | Fox | 24/115 H X |
| 4,322,077 | 3/1982 | Van't Hof | 24/115 H X |

FOREIGN PATENT DOCUMENTS

| | | | |
|---|---|---|---|
| 1803861 | 5/1970 | Fed. Rep. of Germany | 24/49 CF |
| 1965280 | 7/1971 | Fed. Rep. of Germany | 24/298 |
| 653211 | 3/1929 | France | 24/56 |
| 233436 | 5/1925 | United Kingdom | 24/49 CC |

*Primary Examiner*—Kenneth J. Dorner
*Assistant Examiner*—Laurie K. Cranmer
*Attorney, Agent, or Firm*—Donald P. Smith

[57] ABSTRACT

A necktie holder of the type adapted to join between a wearer's shirt button and the necktie, and which will tightly embrace the button threads and loosely embrace the narrow end of the necktie. A clip having strong movable jaws forms part of the necktie holder and is arranged to seize a rearward seam on the wide end of the necktie whereby the holder is not visable from the front of the wearer but will keep the necktie in neat and orderly state at all times.

2 Claims, 4 Drawing Figures

NECKTIE HOLDER

BACKGROUND OF INVENTION

1. Field of Invention

This invention relates to an accessory for gentlemen's wearing apparel and more specifically to a device for keeping a gentlemen's necktie in a neat and orderly state despite high velocity winds or vigorous motion of the wearer. The necktie holder is of the type which will loosely embrace the narrow end of a four-in-hand tie, and in addition, has a strong clip which will seize a portion of the wider end of the tie to prevent lateral motion thereof. In use, the holder is not visable from the front of the wearer.

2. Description of the Prior Art

Various necktie holders are known in the art, most of which are adjustable so that they may accommodate neckties of varying widths. In contradistinction to this complexity, this invention offers a structure which is readily adaptable to any necktie and requires only a minimum of adjustment.

Applicant is aware of the below listed patents:

Marien, U.S. Pat. No. 3,173,181;

Albright, U.S. Pat. No. 2,059,301.

Marien shows a necktie holder having two arcuately-shaped members arranged in opposed relation thus forming an open loop to embrace a necktie, a fastener connects the members at one end and has the other ends overlapping; straps are provided to engage each other to limit the size of the loop.

Albright shows a necktie holder consisting of two members slideable, one upon the other, and having a locking structure to engage the series of threads which join a shirt button to a shirt. A chain loop extends between the ends of the members to surround the necktie and limit lateral motion.

None of the above described patents appears to teach or even suggest the invention which will be described hereinafter.

It is accordingly a broad object of the invention to provide a holder which will keep a necktie in a neat and orderly state and which is not visable from the front of the wearer.

It is another object of the invention to provide a necktie holder in which sliding motion of sleeves toward and away from each other vary the diameter of two loops which surround portions of the necktie.

It is yet another object of the invention to provide a necktie holder for use by the wearer of a shirt which comprises an elongated flexible member folded back upon itself to form two loops, one of which is incomplete and has therein a clip provided with strong, movable, toothed jaws secured to each end of the member to close the incomplete loop, and a pair of sleeves embracing the elongated section and slideable thereon. The complete loop is secured to the threads holding a shirt button, the other loop surrounds the narrow length of a necktie, and the clip closes upon a rearward section or seam of the wide length of the tie.

A detailed description of the invention will be made with reference to the accompanying drawings wherein like reference characters designate like or corresponding parts in the several figures.

The following detailed description is of the best methods, structures and modes of carrying out the invention. The description is not to be taken in a limiting sense, but is made for the purpose of illustrating the general principles of the invention. The scope of the invention is defined by the appended claims.

Figure 1:
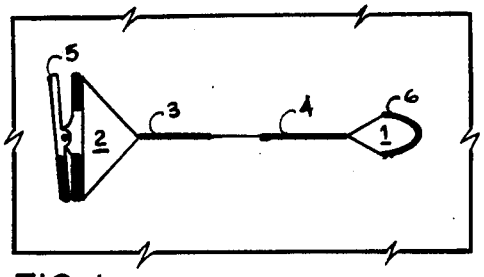
FIG. 1 is a top plan view showing my device as it would be displayed in a retail establishment.

Referring now to FIG. 1, there is shown two spaced loops designated by reference characters 1 and 2 formed from a relatively slender flexible stranded cord. Loop 1 is complete, and loop 2 is incomplete, except for the joining of the respective ends of the cord by a clip 5. The clip has strong toothed jaws which are urged together by a spring. A pair of sleeves, reference characters 3 and 4, are slideable on the joining length between the loops to vary the radii of the loops at the wearer's will. Another sleeve 6 embraces, in part at least, loop 1 to reinforce the cord and prevent undue wear upon the button threads.

Figure 2:
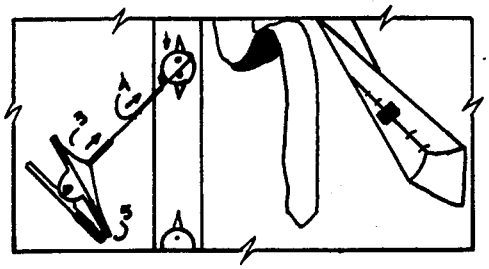
FIG. 2 is a fragmental view of a shirt front showing the device being installed by a wearer wherein one loop is attached to shirt button threads.

In use, loop 1 is placed around a shirt button at a level about six inches from the wearer's belt line as shown in FIG. 2. Both sleeves 3 and 4 are then moved to loop 1 thereby decreasing its radius and causing it to embrace the threads securing the button to the shirt. This motion additionally increases the radius of loop 2.

Figure 3:
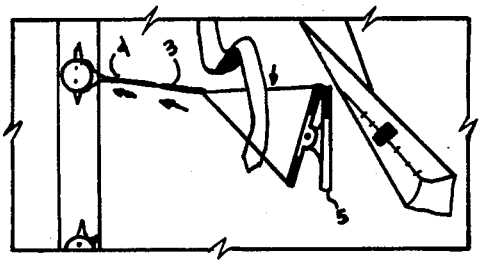
FIG. 3 is a fragmental view of a shirt front showing a second loop embracing a narrow end of a tie.
Figure 4:
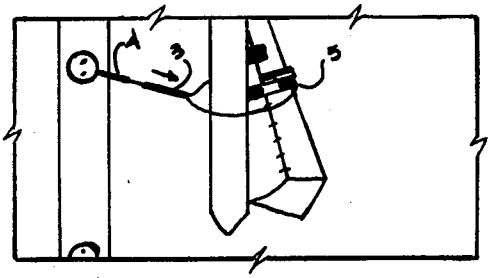
FIG. 4 is a fragmental view of a shirt front showing the device joining between the shirt button threads, embracing the narrow portion of a tie and seizing a part of the wide portion of the tie.

The narrow end of the tie as shown in FIG. 3, is threaded through loop 2 and clip 5 is used to grip the seam of the wide end of the tie as shown in FIG. 4. To complete the assembly, sleeve 3 is moved toward the necktie and sleeve 4 is left in place.

As has been seen from the above description, the invention provides a necktie holder which will limit lateral motion of the necktie, require a definite action by the part of the wearer to remove it so that it will not accidentally be displaced, and is not visable from the front of the wearer.

It will be apparent to those skilled in the art that many changes may be in the construction and arrangement of parts without necessary departing from the scope of the invention as defined in the appended claims.

I claim:

1. An article of manufacture in combination with a shirt and necktie, the shirt having buttons connected by threads and the necktie having an exposed wider portion and a hidden narrower portion comprising:

(a) an elongated flexible member folded in its central area to define a first loop, a second open loop, and an elongated doubled section between the said loops, (b) a clip secured to each respective end of said flexible member to close the second loop, and (c) a pair of sleeves embracing the said elongated doubled section between the said loops and slidable thereon to vary the radii of said loops, whereby in use the said first loop is secured to shirt button threads, the said second loop embraces the necktie hidden narrower portion, and the said clip seizes a rearward segment of the necktie exposed wider portion.

2. The invention according to claim 1 including a third sleeve embracing in part at least the said first loop.

* * * * *